US007975401B2

(12) United States Patent
Beaulac

(10) Patent No.: US 7,975,401 B2
(45) Date of Patent: Jul. 12, 2011

(54) APPARATUS AND METHOD FOR CONTROLLING A CLOTHES DRYER

(75) Inventor: Sébastien Beaulac, LaSalle (CA)

(73) Assignee: Mabe Canada Inc., Burlington (CA)

( * ) Notice: Subject to any disclaimer, the term of this patent is extended or adjusted under 35 U.S.C. 154(b) by 314 days.

(21) Appl. No.: 11/976,796

(22) Filed: Oct. 29, 2007

(65) Prior Publication Data

US 2008/0052954 A1 Mar. 6, 2008

Related U.S. Application Data

(62) Division of application No. 11/412,123, filed on Apr. 27, 2006, now Pat. No. 7,322,126.

(30) Foreign Application Priority Data

Apr. 28, 2005 (CA) ..... 2505565

(51) Int. Cl.
*F26B 21/06* (2006.01)

(52) U.S. Cl. ..... 34/601; 34/565; 34/549; 34/572; 34/603; 34/554; 73/865.9; 705/1; 705/14; 374/141; 706/1

(58) Field of Classification Search ..... 34/601, 34/565, 549, 572, 603, 554; 73/865.9; 706/1; 705/1, 14; 374/141
See application file for complete search history.

(56) References Cited

U.S. PATENT DOCUMENTS 3,217,422 A * 11/1965 Fuqua et al. ..... 34/527
3,372,488 A * 3/1968 Koch et al. ..... 34/536
3,429,317 A * 2/1969 Wochnowski et al. ..... 131/303
3,866,335 A * 2/1975 Neville ..... 34/602
3,883,959 A * 5/1975 Neville ..... 34/599
3,937,227 A * 2/1976 Azumano ..... 131/302
3,944,841 A * 3/1976 Janke ..... 307/38
4,195,415 A * 4/1980 Livings et al. ..... 34/549
4,206,552 A 6/1980 Pomerantz et al.
4,257,170 A * 3/1981 Gestblom et al. ..... 34/553
4,267,643 A * 5/1981 Haried ..... 34/553
4,385,452 A 5/1983 Deschaaf et al.
4,397,101 A * 8/1983 Rickard ..... 34/486
4,412,389 A 11/1983 Kruger
4,422,247 A 12/1983 Deschaaf
4,531,305 A 7/1985 Nagayusa et al.
4,622,759 A 11/1986 Abe et al.
4,640,022 A 2/1987 Suzuki et al.
4,733,479 A 3/1988 Kaji et al.
4,738,034 A 4/1988 Muramatsu et al.

(Continued)

FOREIGN PATENT DOCUMENTS

CA 1156740 11/1983

(Continued)

*Primary Examiner* — Stephen M. Gravini

(57) ABSTRACT

A clothes dryer has a degree of dryness control system that is responsive to moisture level of clothing articles tumbling in a drum and a target moisture value to control the drying cycle of the clothes dryer. The clothes dryer has a load size parameter producing module and an air flow detection parameter module. These modules generate one of two parameter conditions used by the processor to modify or select an appropriate moisture target value. The load size producing parameter module generates one of a small load input parameter and a large load input parameter. The air flow detection module produces one of a first and second air flow parameter to be utilized by the degree of dryness processor. As a result, the processor selects one of four target moisture values from these conditions.

4 Claims, 9 Drawing Sheets

U.S. PATENT DOCUMENTS

| | | | | | |
|---|---|---|---|---|---|
| 4,763,425 | A | * | 8/1988 | Grennan | 34/552 |
| 5,101,575 | A | * | 4/1992 | Bashark | 34/562 |
| 5,172,490 | A | * | 12/1992 | Tatsumi et al. | 34/488 |
| 5,187,879 | A | * | 2/1993 | Holst | 34/261 |
| 5,291,667 | A | | 3/1994 | Joslin et al. | |
| 5,301,438 | A | * | 4/1994 | Tanaka et al. | 34/550 |
| 5,315,765 | A | * | 5/1994 | Holst et al. | 34/260 |
| 5,321,897 | A | * | 6/1994 | Holst et al. | 34/260 |
| 5,347,727 | A | | 9/1994 | Kim | |
| 5,359,788 | A | * | 11/1994 | Gell, Jr. | 34/360 |
| 5,367,787 | A | * | 11/1994 | Ikeda et al. | 34/549 |
| 5,444,924 | A | | 8/1995 | Joslin et al. | |
| 5,500,237 | A | * | 3/1996 | Gell et al. | 426/466 |
| 5,544,428 | A | * | 8/1996 | Kuroda et al. | 34/493 |
| 5,564,831 | A | * | 10/1996 | Bashark | 374/141 |
| 5,570,520 | A | * | 11/1996 | Huffington | 34/535 |
| 5,619,614 | A | * | 4/1997 | Payne et al. | 706/1 |
| 5,651,194 | A | * | 7/1997 | Hayashi | 34/550 |
| 5,755,041 | A | | 5/1998 | Horwitz | |
| 5,764,542 | A | | 6/1998 | Gaudette et al. | |
| 5,852,881 | A | * | 12/1998 | Kuroda et al. | 34/527 |
| 6,047,486 | A | * | 4/2000 | Reck et al. | 34/491 |
| 6,079,121 | A | | 6/2000 | Khadkikar et al. | |
| 6,122,840 | A | | 9/2000 | Chbat et al. | |
| 6,158,148 | A | | 12/2000 | Krausch | |
| 6,199,300 | B1 | | 3/2001 | Heater et al. | |
| 6,446,357 | B2 | | 9/2002 | Woerdehoff et al. | |
| 6,462,564 | B1 | | 10/2002 | Krausch et al. | |
| 6,466,037 | B1 | | 10/2002 | Meerpohl et al. | |
| 6,519,871 | B2 | | 2/2003 | Gardner et al. | |
| 6,779,279 | B2 | * | 8/2004 | Lee et al. | 34/82 |
| 6,792,694 | B2 | | 9/2004 | Lapierre | |
| 6,845,290 | B1 | | 1/2005 | Wunderlin et al. | |
| 6,904,703 | B2 | * | 6/2005 | Naganawa et al. | 34/596 |
| 6,931,759 | B2 | * | 8/2005 | Jeong et al. | 34/485 |
| 6,968,632 | B2 | * | 11/2005 | Guinibert et al. | 34/602 |
| 7,065,905 | B2 | * | 6/2006 | Guinibert et al. | 34/603 |
| 7,117,613 | B2 | * | 10/2006 | Guinibert et al. | 34/534 |
| 7,225,562 | B2 | * | 6/2007 | Guinibert et al. | 34/601 |
| 7,257,905 | B2 | * | 8/2007 | Guinibert et al. | 34/82 |
| 7,322,126 | B2 | * | 1/2008 | Beaulac | 34/554 |
| 7,412,783 | B2 | * | 8/2008 | Guinibert et al. | 34/572 |
| 7,467,483 | B2 | * | 12/2008 | Guinibert et al. | 34/601 |
| 7,503,127 | B2 | * | 3/2009 | DuVal et al. | 34/381 |
| 7,594,343 | B2 | * | 9/2009 | Woerdehoff et al. | 34/491 |
| 7,762,007 | B2 | * | 7/2010 | Guinibert et al. | 34/601 |
| 7,866,059 | B2 | * | 1/2011 | Yoo et al. | 34/427 |
| 7,870,799 | B2 | * | 1/2011 | Neumann | 73/865.9 |
| 2004/0006886 | A1 | * | 1/2004 | Lee et al. | 34/82 |
| 2004/0010937 | A1 | * | 1/2004 | Naganawa et al. | 34/595 |
| 2004/0060197 | A1 | * | 4/2004 | Jeong et al. | 34/595 |
| 2005/0076535 | A1 | * | 4/2005 | Guinibert et al. | 34/601 |
| 2005/0091879 | A1 | * | 5/2005 | DuVal et al. | 34/597 |
| 2005/0115104 | A1 | * | 6/2005 | Guinibert et al. | 34/601 |
| 2006/0162182 | A1 | | 7/2006 | Wong et al. | |
| 2006/0201021 | A1 | * | 9/2006 | Dunsbergen | 34/499 |
| 2006/0242858 | A1 | * | 11/2006 | Beaulac | 34/446 |
| 2006/0288605 | A1 | * | 12/2006 | Carow et al. | 34/446 |
| 2006/0288608 | A1 | * | 12/2006 | Carow et al. | 34/604 |
| 2007/0006477 | A1 | * | 1/2007 | Guinibert et al. | 34/85 |
| 2007/0186438 | A1 | * | 8/2007 | Woerdehoff et al. | 34/486 |
| 2007/0186440 | A1 | * | 8/2007 | Guinibert et al. | 34/603 |
| 2007/0220776 | A1 | * | 9/2007 | Guinibert et al. | 34/603 |
| 2008/0034611 | A1 | * | 2/2008 | Carow et al. | 34/565 |
| 2008/0052951 | A1 | * | 3/2008 | Beaulac | 34/549 |
| 2008/0052954 | A1 | * | 3/2008 | Beaulac | 34/572 |
| 2008/0120868 | A1 | * | 5/2008 | Morrison et al. | 34/572 |
| 2008/0184586 | A1 | * | 8/2008 | Yoo et al. | 34/427 |
| 2009/0159301 | A1 | * | 6/2009 | Chatot et al. | 169/56 |
| 2009/0260256 | A1 | * | 10/2009 | Beaulac | 34/528 |
| 2010/0000112 | A1 | * | 1/2010 | Carow et al. | 34/357 |
| 2010/0000114 | A1 | * | 1/2010 | Dalton et al. | 34/389 |
| 2010/0000118 | A1 | * | 1/2010 | Cunningham | 34/487 |
| 2010/0058611 | A1 | * | 3/2010 | Neumann | 34/487 |
| 2010/0319213 | A1 | * | 12/2010 | Kim et al. | 34/565 |

FOREIGN PATENT DOCUMENTS

| | | | | |
|---|---|---|---|---|
| CA | 1204481 | | | 5/1986 |
| CA | 2345631 | | | 11/2001 |
| DE | 3436342 | A1 | * | 4/1986 |
| DE | 4400030 | C1 | * | 9/1995 |
| DE | 19506919 | A1 | * | 8/1996 |
| EP | 88175 | A1 | * | 9/1983 |
| EP | 106646 | A2 | * | 4/1984 |
| EP | 401768 | A2 | * | 12/1990 |
| EP | 915199 | A1 | * | 5/1999 |
| EP | 1736592 | A2 | * | 12/2006 |
| FR | 2789381 | A1 | * | 8/2000 |
| JP | 54094766 | A | * | 7/1979 |
| JP | 56104343 | A | * | 8/1981 |
| JP | 57043640 | A | * | 3/1982 |
| JP | 57147035 | A | * | 9/1982 |
| JP | 59012666 | A | * | 1/1984 |
| JP | 01242097 | A | * | 9/1989 |
| JP | 02159300 | A | * | 6/1990 |
| JP | 02249598 | A | * | 10/1990 |
| JP | 02264698 | A | * | 10/1990 |
| JP | 03170199 | A | * | 7/1991 |
| JP | 03178699 | A | * | 8/1991 |
| JP | 05337292 | A | * | 12/1993 |
| JP | 07008691 | A | * | 1/1995 |
| JP | 07265596 | A | * | 10/1995 |
| JP | 09225196 | A | * | 9/1997 |
| JP | 2000237500 | A | * | 9/2000 |
| JP | 2003111999 | A | * | 4/2003 |
| WO | WO 0047810 | A1 | * | 8/2000 |
| WO | WO 03087459 | A1 | * | 10/2003 |

* cited by examiner

APPARATUS AND METHOD FOR CONTROLLING A CLOTHES DRYER

CROSS REFERENCE TO RELATED APPLICATION

This application is a divisional of U.S. patent application Ser. No. 11/412,123 filed Apr. 27, 2006 now U.S. Pat. No. 7,322,126.

FIELD OF THE INVENTION

The present invention relates to an appliance for drying clothing articles, and more particularly, to a dryer using microprocessor based controls for controlling dryer operation.

BACKGROUND OF THE INVENTION

It is common practice to detect the moisture level of clothes tumbling in a dryer by the use of sensors located in the dryer drum. A voltage signal from the moisture sensor is used to estimate the moisture content of the articles being dried based on the actual characteristics of the load being dried. The sensors are periodically sampled to provide raw voltage values that are then filtered or smoothed, and inputted to a processor module that determines when the clothes are dry, near dry, or at a target level of moisture content, and the drying cycle should terminate.

The filtered voltage is typically compared with a target voltage stored in memory associated with the microprocessor. This target voltage is a predetermined voltage determined for the dryer. Once the target voltage is reached, this is an indication to the dryer that a predetermined degree of dryness for the load has been reached. The microprocessor controls the drying cycle and/or cool down cycle of the dryer in accordance with preset user conditions and the degree of dryness of the load in the dryer relative to the target voltage.

The target voltage is chosen for a predetermined or average load size and a preset air flow rate for the dryer. This target voltage may not accurately reflect different load sizes and differing air flow conditions for the dryer resulting in the automatic drying cycle either drying the clothing too long or insufficiently.

For example, the smaller the load the higher the target voltage should be set because larger loads are in contact with the sensors more frequently and this reduces the value of the filtered voltage signal.

Also, the air flow influences the level of the smoothed or filtered voltage signal. The greater the air flow through the dryer the more clothes are pulled towards the front of the dryer increasing the frequency of contact of the clothing with the moisture sensor when the moisture sensor is mounted at the front of the dryer drum.

Accordingly, there is a need for a drying algorithm that sets its target voltage associated with the moisture content of the clothes and which takes into consideration the influences associated with load size and/or air flow condition.

BRIEF DESCRIPTION OF THE INVENTION

The present invention relates to a clothes dryer having a degree of dryness control system or processor responsive to the moisture level of clothing articles tumbling in a drum and a target moisture value to control the drying cycle of the clothes dryer. The clothes dryer comprises one or both of a load size parameter generating module and an air flow parameter generating module. Each of these modules may generate one of two parameter conditions to be used separately or in combination by the processor to modify or select a more appropriate target moisture value to be utilized by the degree of dryness control system. It is envisaged that each module may generate more than two parameter conditions if sufficient memory is available.

In one embodiment, the load size parameter generating module generates one of a small load input parameter and a large load input parameter to be utilized by the degree of dryness processor. In another embodiment, the air flow generating module produces one of a first and second air flow parameter to be utilized by the degree of dryness processor. In yet another embodiment, both these modules are utilized to each generate two conditions. As a result, the processor selects one of four target moisture values from these conditions.

In an embodiment, the air flow generating module is coupled to an inlet temperature sensor to sense inlet temperature of heated air entering into the drum. This module measures a first slope corresponding to the rise of the inlet temperature of air entering the drum during a first initial time period of operation of the dryer and compares the first slope with a first value indicative of a first predetermined slope for rise of the inlet temperature during the first initial period. This module generates and transmits to the processor one of a first air flow input parameter or a second air flow input parameter each of which is indicative of a different air flow condition in the dryer. The first air flow parameter is generated when this module determines that the first slope is less than the first value. The second air flow input parameter is generated when this module determines that the first slope is greater than the first value.

It should be understood that the air flow parameter corresponds to air flow through the dryer drum and is usually dependent upon the length of exhaust venting from the dryer to atmosphere. Poor air flow through the drum and exhaust venting relates to a relatively longer venting and dirty exhaust while good air flow through the drum and exhaust venting relates to a shorter venting and clean exhaust. In a preferred aspect of the present invention, the air flow parameter is measured as a function of the air flow restriction or blockage of air flow through the dryer which is inversely proportional to the rate of air flow through the dryer. Accordingly, the term air flow parameter is used herein to include one of either an air flow restriction or an air flow rate.

In another embodiment the load size parameter generating module is coupled to the outlet temperature sensor to sense outlet temperature of air exiting from the drum. This module measures a second slope corresponding to the rise of the outlet temperature of air exiting from the drum during a second initial time period of operation of the dryer, compares the second slope with a second value indicative of a second predetermined slope for rise of the outlet temperature during the second initial period, and generates and transmits to the processor one of a small load input parameter and a large load input parameter. The small load input parameter is generated when this module determines that the second slope is greater than the second value. The large load input parameter is generated when this module determines that the second slope is less than the second value.

In one embodiment of the invention there is provided an appliance for drying clothing articles. The appliance comprises a drum for receiving the clothing articles, a motor for rotating the drum about an axis, a heater for supplying heated air to the drum during a drying cycle, a moisture sensor for providing a moisture signal indicative of the moisture content of the clothing articles, an inlet temperature sensor for sensing temperature of the heated air flowing into the drum, a processor, and a first parameter generating module. The processor is coupled to the moisture sensor for estimating the stop time of the dry cycle as the dry cycle is executed based on a signal representative of the moisture content of the clothing articles and a selected target signal. The processor selects the selected target signal based on at least one input parameter received from the first parameter generating module. The first parameter generating module is coupled to the inlet temperature sensor to sense inlet temperature of heated air entering into the drum. The first parameter generating module measures a first slope corresponding to the rise of the inlet temperature of air entering the drum during a first initial time period of operation of the dryer and compares the first slope with a first value indicative of a first predetermined slope for rise of the inlet temperature during the first initial period. The first parameter generating module generates and transmits to the processor one of a first air flow input parameter or a second air flow input parameter. The first air flow input parameter is generated when the first parameter generating module determines that the first slope is less than the first value. The second air flow input parameter is generated when the first parameter generating module determines that the first slope is greater than the first value.

In accordance with another embodiment there is provided an appliance for drying clothing articles. The appliance comprises a drum for receiving the clothing articles, a motor for rotating the drum about an axis, a heater for supplying heated air to the drum during a drying cycle, a moisture sensor for providing a moisture signal indicative of the moisture content of the clothing articles, an outlet temperature sensor for sensing temperature of air exiting from the drum, a processor and a second parameter generating module. The processor is coupled to the moisture sensor for estimating the stop time of the dry cycle as the dry cycle is executed based on a signal representative of the moisture content of the clothing articles and a selected target signal. The processor selects the selected target signal based on at least one input parameter received from the second parameter generating module. The second parameter generating module is coupled to the outlet temperature sensor to sense outlet temperature of air exiting from the drum. The second parameter generating module measures a second slope corresponding to the rise of the outlet temperature of air exiting from the drum during a second initial time period of operation of the dryer, compares the second slope with a second value indicative of a second predetermined slope for rise of the outlet temperature during the second initial period, and generates and transmits to the processor one of a small load input parameter and a large load input parameter. The small load input parameter is generated when the second parameter generating module determines that the second slope is greater than the second value. The large load input parameter is generated when the second parameter generating module determines that the second slope is less than the second value.

In another embodiment both the first and second parameter generating modules are present in the clothes dryer. It is envisaged that the processor has a look up table of target moisture values and selects one of the target moisture values based on the generated load size parameter and air flow parameter.

The invention provides a method for modifying a degree of dryness control system for a clothes dryer that controls the drying of clothing articles tumbling in a drum in accordance with a target moisture value. The method comprises generating an input parameter and modifying the target moisture value based on the generated input parameter. The generating of the input parameter comprises the steps of:

sensing inlet temperature of air entering into the drum;

measuring a first slope corresponding to rise of the inlet temperature during a first initial time period of operation of the dryer;

comparing the first slope with a first value indicative of a first predetermined slope representative of a predetermined inlet temperature rise;

generating a first air flow input parameter for use by the degree of dryness control system when the first slope is less than the first value; and, generating a second air flow input parameter for use by the degree of dryness control system when the first slope is greater than the first value.

The invention also provides a method for modifying a degree of dryness control system for a clothes dryer that controls the drying of clothing articles tumbling in a drum in accordance with a target moisture value. The method comprises generating an input parameter and modifying the target moisture value based on the generated input parameter. The generating of the input parameter comprises the steps of:

sensing outlet temperature of air exiting from the drum;

measuring a second slope corresponding to rise of the outlet temperature during a second initial time period of operation of the dryer;

comparing the second slope with a second value indicative of a second predetermined slope representative of a predetermined outlet temperature rise;

generating a small load input parameter for use by the degree of dryness control system when the second slope is greater than the second value; and, generating a large load input parameter for use by the degree of dryness control system when the second slope is less than the second value.

BRIEF DESCRIPTION OF THE DRAWINGS

For a better understanding of the nature and objects of the present invention reference may be had by way of example to the accompanying diagrammatic drawings.

DETAILED DESCRIPTION OF THE INVENTION

Figure 1:
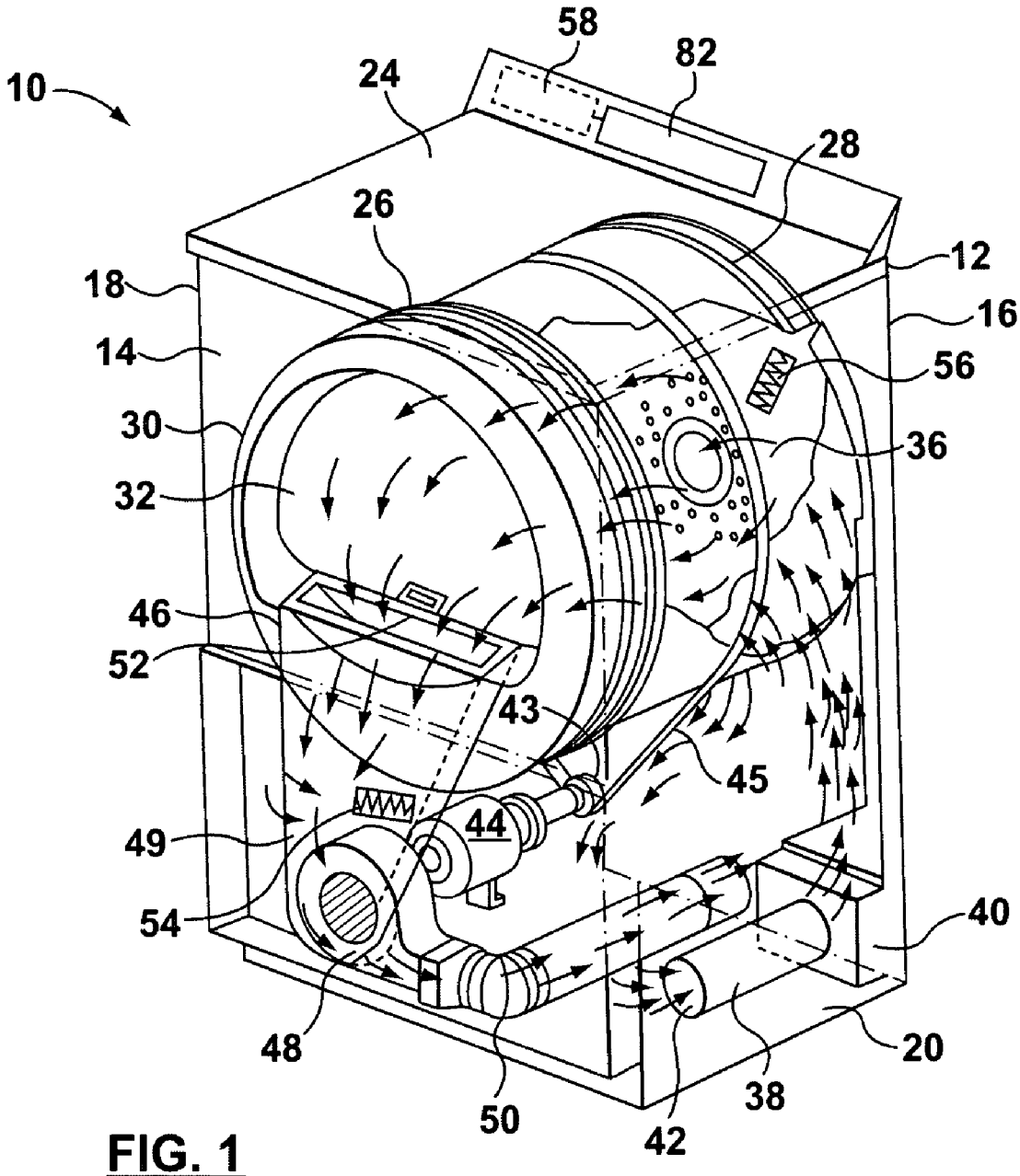
FIG. 1 is a perspective view of an exemplary clothes dryer that may benefit from the present invention.

FIG. 1 shows a perspective view of an exemplary clothes dryer 10 that may benefit from the present invention. The clothes dryer includes a cabinet or a main housing 12 having a front panel 14, a rear panel 16, a pair of side panels 18 and 20 spaced apart from each other by the front and rear panels, and a top cover 24. Within the housing 12 is a drum or container 26 mounted for rotation around a substantially horizontal axis. A motor 44 rotates the drum 26 about the horizontal axis through, for example, a pulley 43 and a belt 45. The drum 26 is generally cylindrical in shape, has an imperforate outer cylindrical wall 28, and is closed at its front by a wall 30 defining an opening 32 into the drum 26. Clothing articles and other fabrics are loaded into the drum 26 through the opening 32. A plurality of tumbling ribs (not shown) are provided within the drum 26 to lift the articles and then allow them to tumble back to the bottom of the drum as the drum rotates. The drum 26 includes a rear wall 34 rotatably supported within the main housing 12 by a suitable fixed bearing. The rear wall 34 includes a plurality of holes 36 that receive hot air that has been heated by a heater such as a combustion chamber 38 and a rear duct 40. The combustion chamber 38 receives ambient air via an inlet 42. Although the exemplary clothes dryer 10 shown in FIG. 1 is a gas dryer, it could just as well be an electric dryer having electric resistance heater elements located in a heating chamber positioned adjacent the imperforate outer cylindrical wall 28 which would replace the combustion chamber 38 and the rear duct 40. The heated air is drawn from the drum 26 by a blower fan 48 which is also driven by the motor 44. The air passes through a screen filter 46 which traps any lint particles. As the air passes through the screen filter 46, it enters a trap duct seal 48 and is passed out of the clothes dryer through an exhaust duct 50. After the clothing articles have been dried, they are removed from the drum 26 via the opening 32.

In one exemplary embodiment of this invention, a moisture sensor 52 is used to predict the percentage of moisture content or degree of dryness of the clothing articles in the container. Moisture sensor 52 typically comprises a pair of spaced-apart rods or electrodes and further comprises circuitry for providing a voltage signal representation of the moisture content of the articles to a controller 58 based on the electrical or ohmic resistance of the articles. The moisture sensor 52 is located on the front interior wall of the drum and alternatively have been mounted on the rear drum wall when this wall is stationary. In some instances the moisture sensor has been used on a baffle contained in the dryer drum. By way of example and not of limitation, the sensor signal may be chosen to provide a continuous representation of the moisture content of the articles in a range suitable for processing by controller 58. It will be appreciated that the signal indicative of the moisture content need not be a voltage signal being that, for example, through the use of a voltage-controlled oscillator, the signal moisture indication could have been chosen as a signal having a frequency that varies proportional to the moisture content of the articles in lieu of a signal whose voltage level varies proportional to the moisture content of the articles.

As the clothes are tumbled in the dryer drum 26 they randomly contact the spaced-apart electrodes of stationary moisture sensor 52. Hence, the clothes are intermittently in contact with the sensor electrodes. The duration of contact between the clothes and the sensor electrodes is dependent upon several factors, such as drum rotational speed, the type of clothes, the amount or volume of clothes in the drum, and the air flow through the drum. When wet clothes are in the dryer drum and in contact with the sensor electrodes, the resistance across the sensor is low. Conversely, when the clothes are dry and contacting the sensor electrodes, the resistance across the sensor is high and indicative of a dry load. However, there may be situations that could result in erroneous indications of the actual level of dryness of the articles. For example, in a situation when wet clothes are not contacting the sensor electrodes, such as, for example, a small load, the resistance across the sensor is very high (open circuit), which would be falsely indicative of a dry load. Further, if a conductive portion of dry clothes, such as a metallic button or zipper, contacts the sensor electrodes, the resistance across the sensor would be low, which would be falsely indicative of a wet load. Hence, when the clothes are wet there may be times when the sensor will erroneously sense a dry condition (high resistance) and, when the clothes are dry, there may be times when the sensor will erroneously sense a wet condition (low resistance).

Accordingly, noise-reduction and smoothing is provided by controller 58 that leads to a more accurate and reliable sensing of the actual dryness condition of the articles and this results in more accurate and reliable control of the dryer operation. However, noise-reduction by itself does not fully compensate for varying load sizes and or different dryers having different air flow restrictions due to different venting.

The controller 58 is responsive to the voltage signal from moisture sensor 52 and predicts a percentage of moisture content or degree of dryness of the clothing articles in the container as a function of the resistance of the articles. As suggested above, the value of the voltage signal supplied by moisture sensor 52 is related to the moisture content of the clothes. For example, at the beginning of the cycle when the clothes are wet, the voltage from moisture sensor may range between about one or two volts. As the clothes become dry, the voltage from moisture sensor 52 may increase to a maximum of about five volts, for example.

The controller 58 is also coupled with an inlet temperature sensor 56, such as, for example, a thermistor. The inlet temperature sensor 56 is mounted in the dryer 10 in the air stream flow path entering into the drum 26. The inlet temperature sensor 56 senses the temperature of the air entering the drum 26 and sends a corresponding temperature signal to the controller 58. The controller is also coupled with an outlet temperature sensor 54, such as, for example, a thermistor. The outlet temperature sensor 54 is shown located in the trap duct 49 and alternatively may be mounted in exhaust duct 50. The outlet temperature sensor 54 senses the temperature of the air leaving the drum 26 and sends a corresponding temperature signal to the controller 58. The controller 58 interprets these signals to generate an air flow parameter based on the inlet temperature rise and/or a load size parameter based on the outlet temperature rise. These parameters are utilized to select a target moisture signal which in turn is utilized by the controller 58 in conjunction with the filtered, or noise-reduced, voltage signal from the moisture sensor 52 to control operation of the dryer 10.

Figure 2:
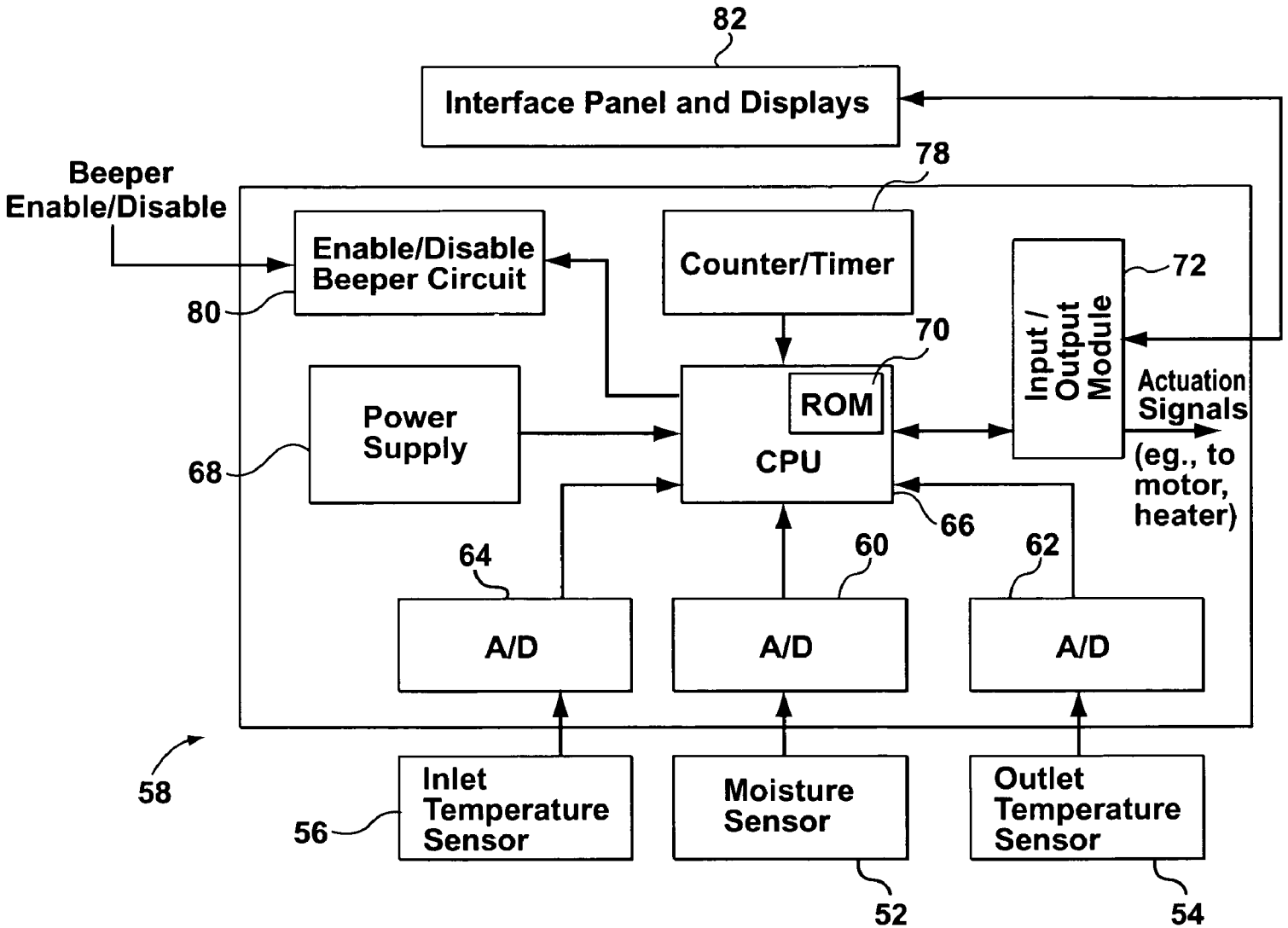
FIG. 2 is a block diagram of a controller system used in the present invention.

A more detailed illustration of the controller 58 is shown in FIG. 2. Controller 58 comprises an analog to digital (A/D) converter 60 for receiving the signal representations sent from moisture sensor 52. The signal representation from A/D converter 60 and a counter/timer 78 is sent to a central processing unit (CPU) 66 for further signal processing which is described below in more detail. The CPU 66 also receives inlet and outlet temperature signals respectively from the inlet temperature sensor 56, via analog to digital (A/D) converter 62, and the outlet temperature sensor 54 via analog to digital (A/D) converter 64. The CPU 66, which receives power from a power supply 68, comprises one or more processing modules stored in a suitable memory device, such as a read only memory (ROM) 70, for predicting a percentage of moisture content or degree of dryness of the clothing articles in the container as a function of the electrical resistance of the articles. It will be appreciated that the memory device need not be limited to ROM memory being that any memory device, such as, for example, an eraseable programmable read only memory (EPROM) that stores instructions and data will work equally effective. Once it has been determined that the clothing articles have reached a desired degree of dryness, then CPU 66 sends respective signals to an input/output module 72 which in turn sends respective signals to deenergize the motor and/or heater. As the drying cycle is shut off, the controller may activate a beeper via an enable/disable beeper circuit 80 to indicate the end of the cycle to a user. An electronic interface and display panel 82 allows for a user to program operation of the dryer and further allows for monitoring progress of respective cycles of operation of the dryer.

Figure 3:
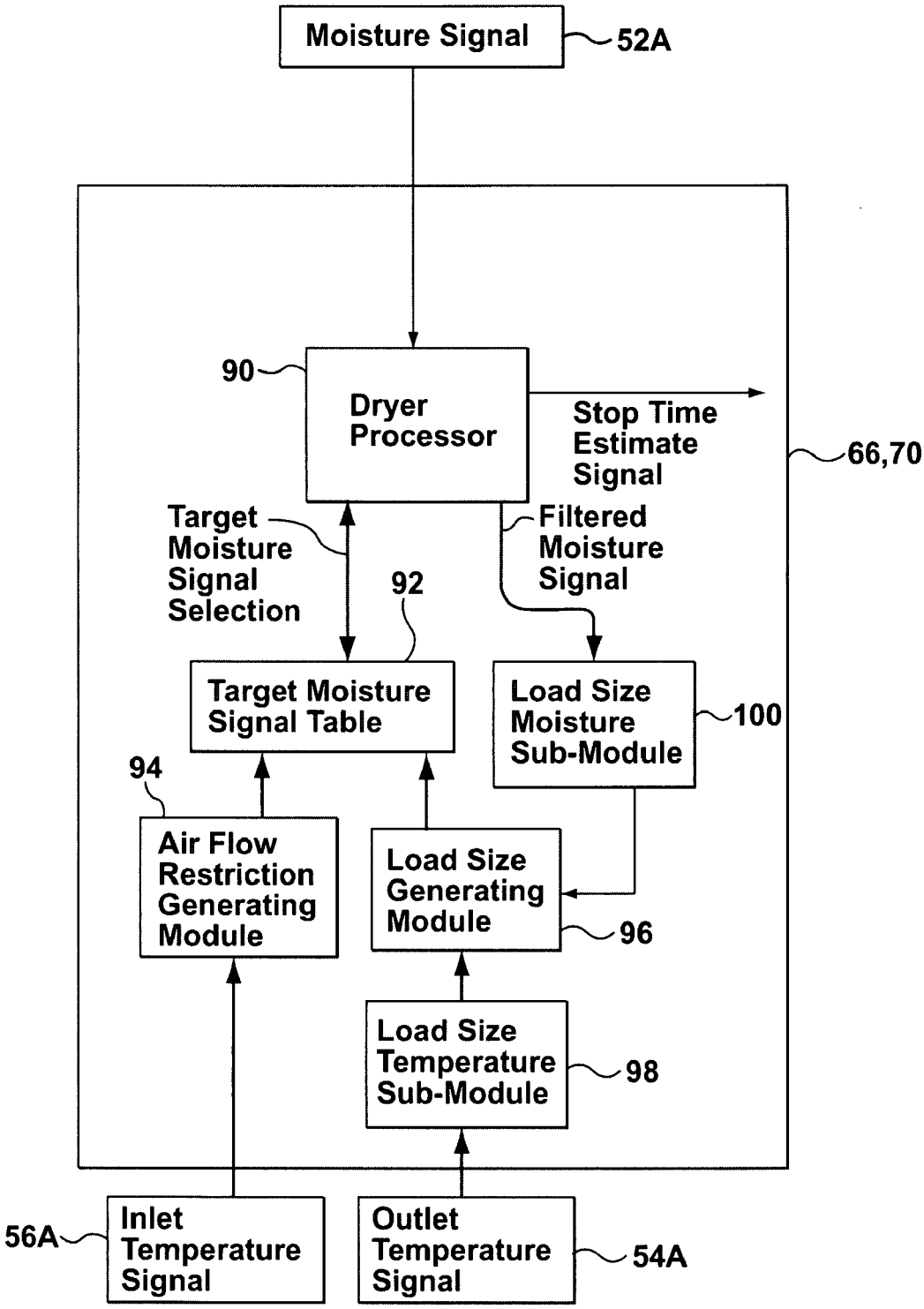
FIG. 3 is a block diagram showing the processor and parameter generating modules of the present invention.

The CPU 66 and the ROM 70 may be configured as shown in FIG. 3 to comprise a dryer processor 90. Processor 90 estimates the stop time and controls the stopping of the dryer 10 based on a moisture signal 52A received from the moisture sensor 52. The processor 90 filters the moisture signal and compares this with a target moisture signal to control the operation of the dryer 10. There are many common methods and systems for filtering the moisture signal. For more detailed information on the filtering of this signal, reference may be had to published Canadian patent application 2,345,631 which was published on Nov. 2, 2001. In accordance with the present invention, the processor 90 selects a target moisture signal from a target moisture signal table 92.

Figure 4:
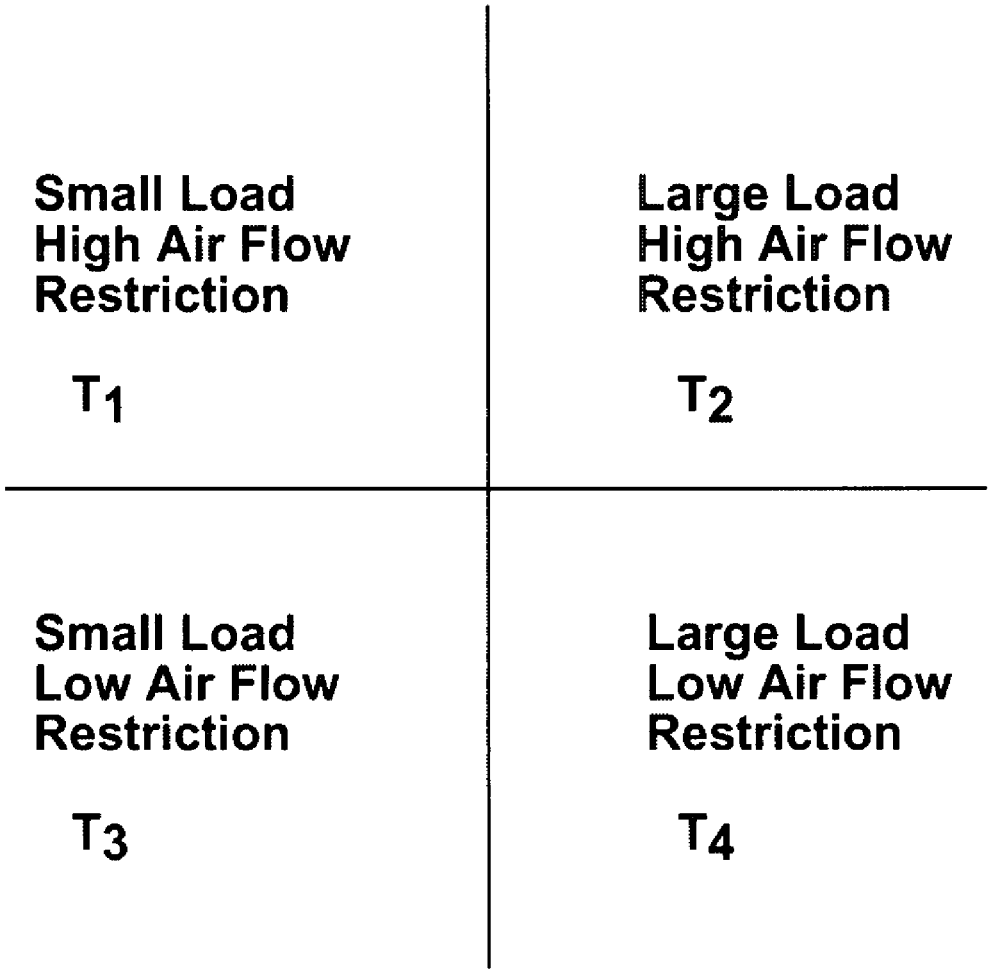
FIG. 4 is a table showing selection criteria for the target moisture value.

Referring to FIG. 4, the target moisture signal table is shown broken into four quadrants. Each quadrant represents a different target voltage given by the letters $T_1$, $T_2$, $T_3$, $T_4$. The target voltage to be utilized by the processor 90 is dependent upon input parameters received from air flow generating module 94 and load size generating module 96. The air flow generating module 94 provides either a first air flow parameter or a second air flow parameter to the target moisture signal table 92. The load size generating module 96 provides either a small load parameter or a large load parameter to the target moisture signal table 92. Accordingly, the quadrants shown in FIG. 4 represent four target voltages. Target voltage $T_1$ is associated with a small load input parameter and a second air flow parameter being received respectively from the modules 96 and 94. The target voltage $T_2$ of the target moisture signal table 92 is chosen when a large load parameter is received from the module 96 and a second air flow parameter is received from module 94. Target voltage $T_3$ is selected when a small load input parameter is received from module 96 and a first air flow parameter is received from module 94. Also, target voltage $T_4$ is utilized by the processor 90 when a large load input parameter is received from module 96 and a first air flow input parameter is received from module 94. It should be understood that while four quadrants are shown, it is envisaged that in an alternative embodiment the target voltage may comprise a selection associated only with a first air flow or a second air flow parameter. Alternatively, the target voltage moisture signal may be derived from either the receipt of a small load parameter or a large load parameter.

The air flow generating module 94 is connected to the inlet temperature sensor 56 and receives an inlet temperature signal 56A. The inlet temperature signal 56A is the temperature of heated air entering into the drum 12.

Figure 5:
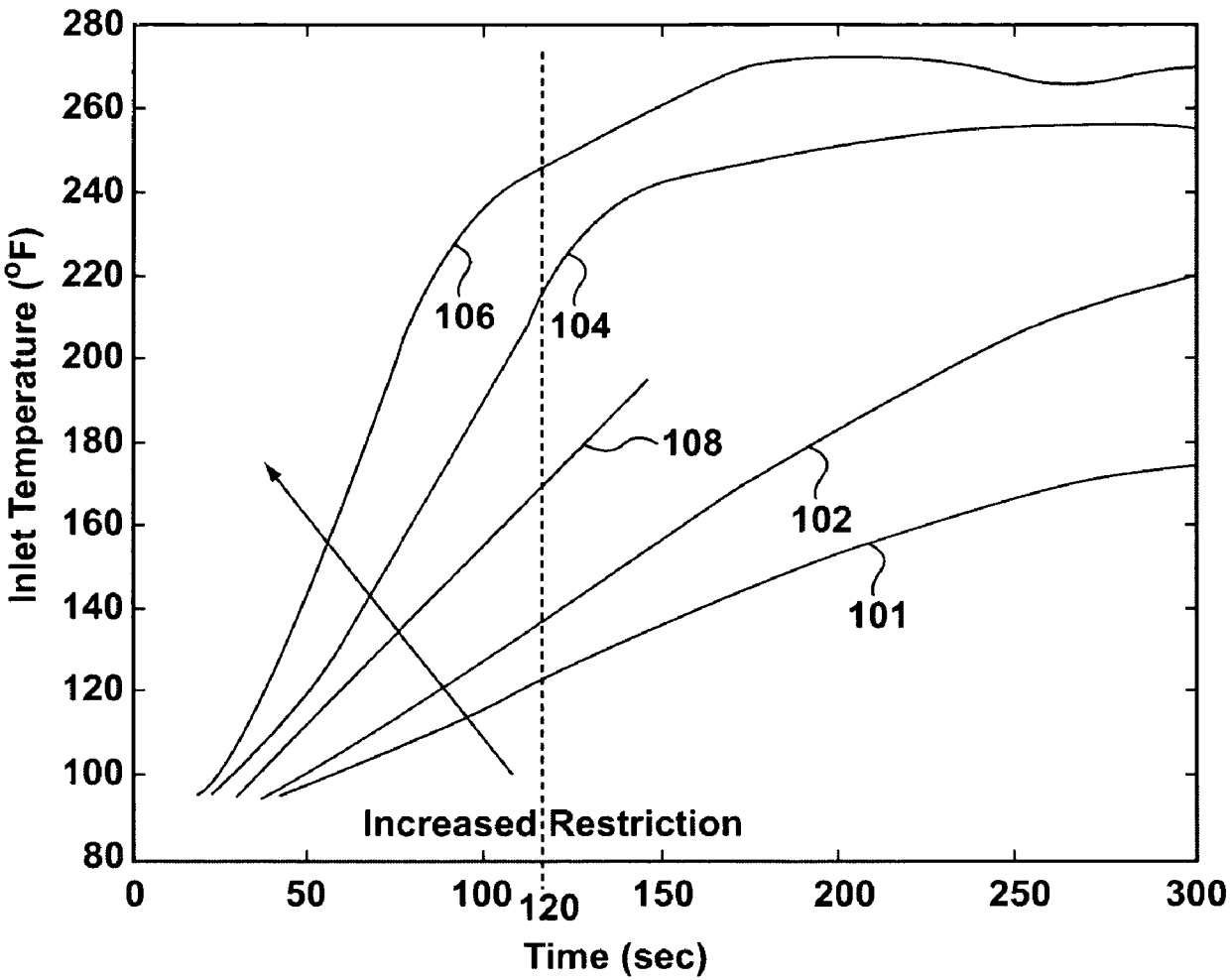
FIG. 5 is a plot of inlet temperature rise vs. time for different air flow restrictions.

Referring to FIG. 5 there is shown four curves 101, 102, 104, and 106 showing the temperature rise at the inlet to the drum 12 for four different air flow conditions as would be sensed from inlet temperature sensor or thermister 56. It should be understood that the these curves are related to a cap type of air flow restriction utilized when testing the dryer. Other types of restrictions, such as, for example, cone type restrictions may be used to generate similar curves. The curves are thus generated to be representative of air flow blockage in a dryer exhaust associated with the length of exhaust venting between the dryer and atmosphere. The size of the restrictions mentioned hereinafter correspond inversely to a vent length. That is, the greater the restriction or blockage, the smaller the air flow restriction size and the longer the venting. Curve 101 is exemplary of the temperature rise in a dryer having an air flow restriction of 3.5 inches. Curve 102 is exemplary of an air flow rise in a dryer having a restriction of 2.65 inches. Curve 104 is exemplary of a temperature rise in a dryer having an air flow restriction of 1.75 inches. Curve 106 is exemplary of a temperature rise at the inlet of a dryer drum having an air flow restriction of 1.5 inches. Line 108 represents a predetermined slope which is discussed in more detail hereinafter. From the slope of the curves it is seen that about 120 seconds, or 2 minutes, into the drying cycle is sufficient time to determine the slope of each of the curves, compare the slope with the predetermined slope value 108 and, from the comparison, generate an air flow parameter. The initial rate of the temperature increase is proportional to the air flow rate and air flow restriction, and therefore to the vent length used in the dryer. The air flow parameter is also independent of the load type and size. It should be understood that while the detailed description relates to an air flow parameter being generated that relates to a measurement of air flow restriction or blockage, the air flow parameter may also be obtained by testing the dryer utilizing a measurement of air flow through the dryer.

Figure 6:
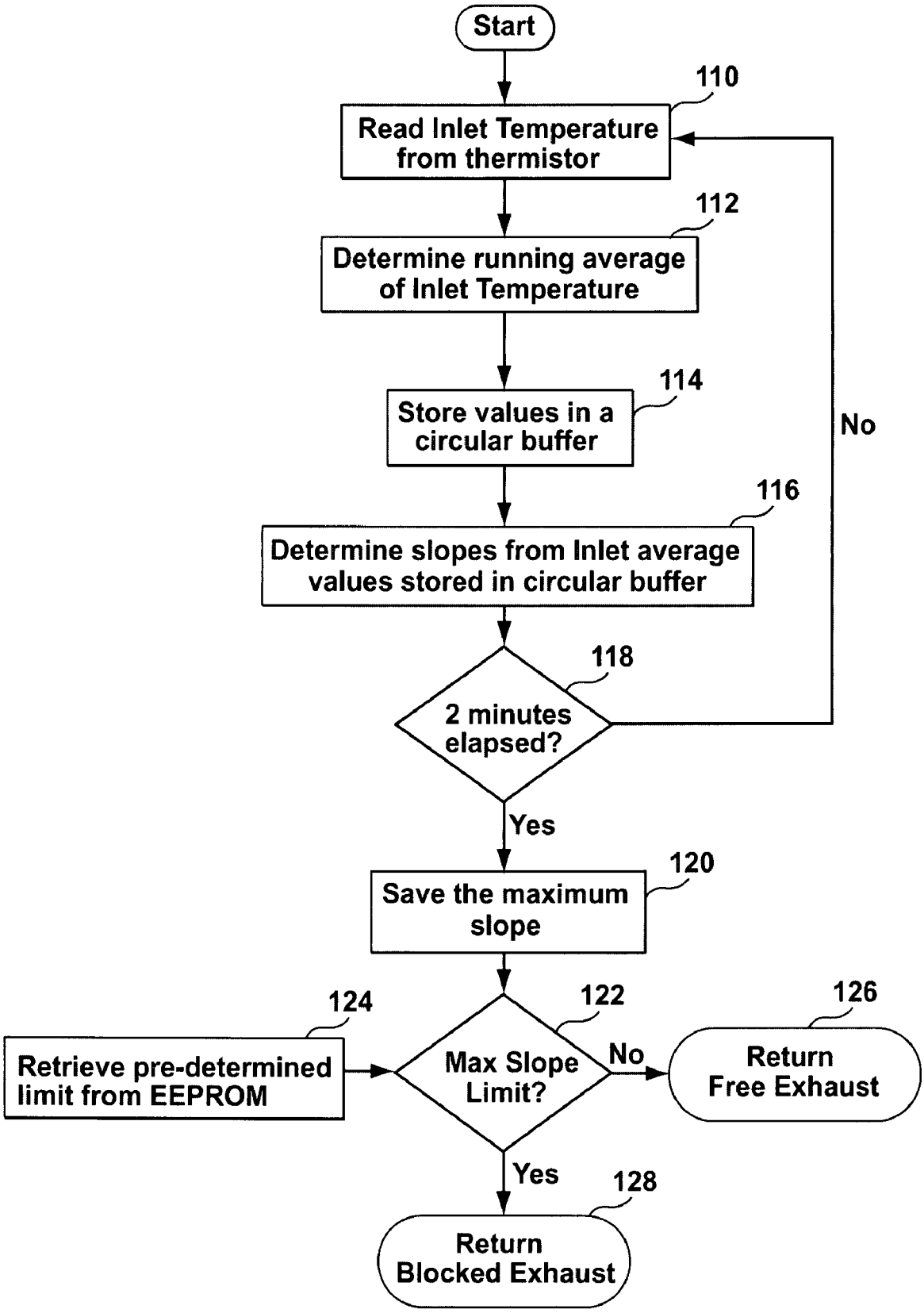
FIG. 6 is an exemplary flow chart for generating an air flow input parameter in accordance with the present invention.

Referring to FIG. 6 there is shown the steps executed by the air flow restriction generating module 94 to generate either tile second air flow restriction or the first air flow restriction parameter. At step 110, the module 94 reads the inlet temperature from the thermistor or temperature sensor 56 and thereby senses the inlet temperature of air entering into the drum 26. The module 94 then determines a running average of the inlet temperature at step 112 and stores this value or running average in a circular buffer 114. By taking a running average of the inlet temperature, which may be an average of 8 temperature samples, the average compensates for potentially any noise in the sensed temperature. This averaging may be the average of eight consecutive samples followed by the average of the next mutually exclusive eight consecutive samples. Alternatively the average may comprise averaging eight samples after each eighth sample such that each average is calculated for each sample and the proceeding 7 samples. It should be understood that any number of samples other than eight may be chosen for determining the average so long as the number of samples and the time delay between samples effectively compensates for noise in the sample set. At step 116 the module 94 determines the slope from the inlet temperature average values stored in a circular buffer. The circular buffer in step 114 stores two values and with each new value stored the oldest value is erased from the buffer. Similarly, the circular buffer 116 also stores the last slope and the next slope being determined eliminates or erases the previous slope. In this way the circular buffers 114 and 116 require minimal storage space in memory. At step 118 module 94 determines if 120 seconds or 2 minutes has elapsed. If the 2 minutes has elapsed then no more averages and slopes are determined. For every average that is determined under the two minute period, this average is sent to a buffer 120 which saves the maximum slope. That is the slope determined at 116 is compared with the previous slope saved in this buffer 120. Accordingly during the initial two minute time period only the maximum slope value associated with the temperature rise is stored in buffer 120 by the module 94. In effect, the module 94 has measured a first slope or maximum slope corresponding to the temperature rise of the inlet temperature of air entering the drum during a first initial time period of operation of the dryer. At decision step 122, processor 94 determines if this maximum or first slope corresponds to a predetermined slope or limit. This limit is graphically shown in FIG. 5 as the straight slope line 108. Line 108 is retrieved from the memory at step 124. If the slope is greater than the limit, a second air flow signal or blocked exhaust signal is returned to the target moisture signal table 92 at step 128. If the maximum slope measured is less than or equal to the predetermined slope or limit associated with curve 108, then a first air flow signal associated with a free exhaust is returned at 126 to the target moisture signal table 92. In the embodiment shown in FIG. 5, the slope of line 108 corresponds to a predetermined limit of an air flow of which corresponds to an household average of exhaust conditions.

The generation of the load size parameter in the load size generating module 96 utilizes a load size temperature sub-module 98 and a load size moisture sub-module 100.

The load size temperature sub-module 98 generates one of the first small load signal and a first large load signal that is sent to the load size generating module 96. This first small or large load signal is a temperature related signal related to the output temperature signal 54A provided by the outlet thermistor or temperature sensor 54.

Figure 7:
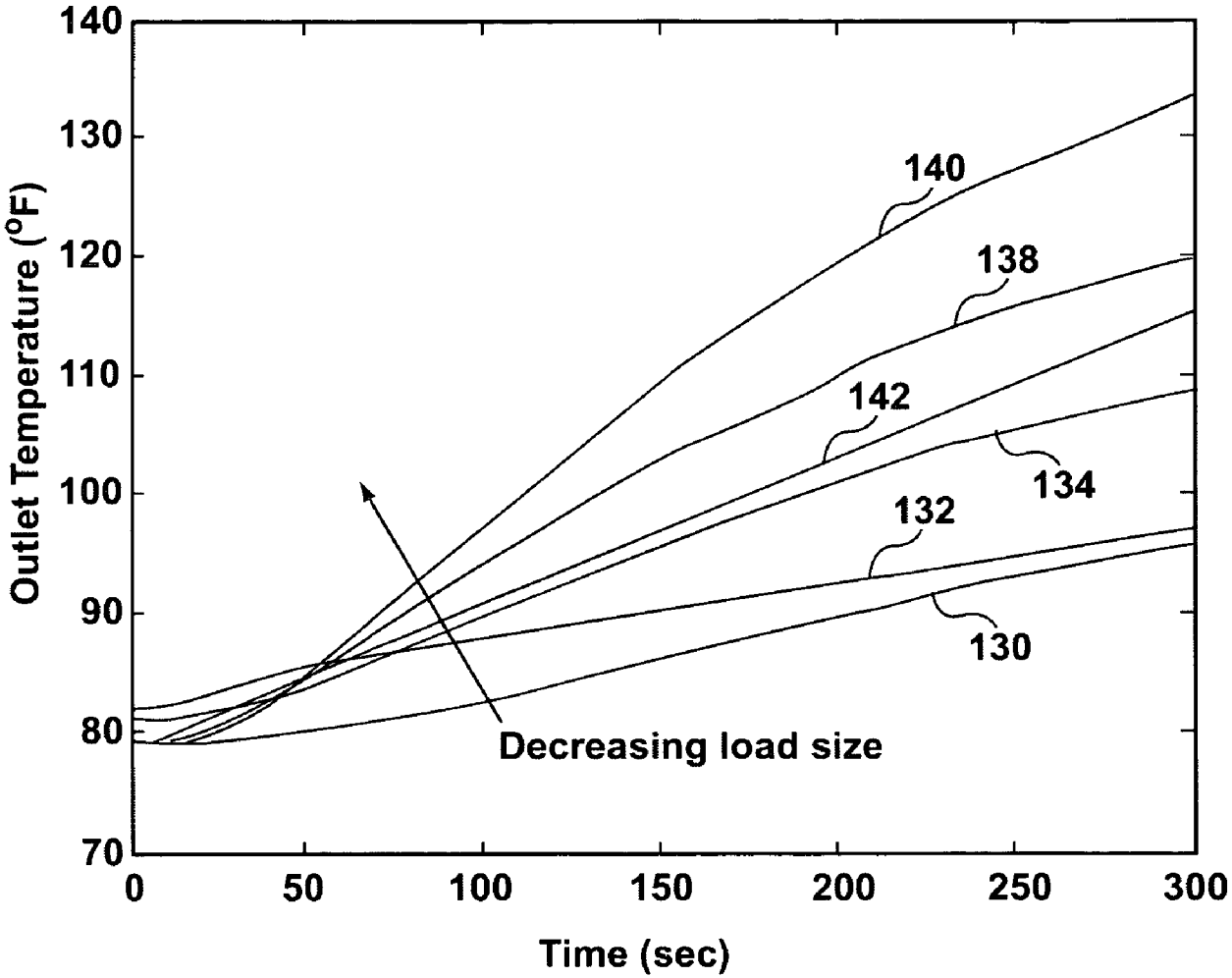
FIG. 7 is a plot of outlet temperature rise vs. time for different load sizes.

Referring to FIG. 7 there is shown a set of curves 130, 132, 134, 138, and 140 which show the rise in the outlet temperature from the drum 26 over time. In particular the time range shown is for 300 seconds or 5 minutes. Curve 130 is exemplary of a load size of about twelve pounds. Curve 132 is exemplary of a load size of about seven pounds. Curve 134 is exemplary of a load size of about four pounds. Curve 138 is exemplary of a load size of about two pounds. Curve 140 is exemplary of a load size of about one pound. Line 142 represents a predetermined slope value for a load size of approximately four pounds. The initial rate of temperature increase at the outlet of the drum 26 is proportional to the load size and the fabric. This rate of temperature increase is also independent of the restriction or any other ambient conditions. The temperature rise is dependent upon the energy source be it gas or electric.

Figure 8:
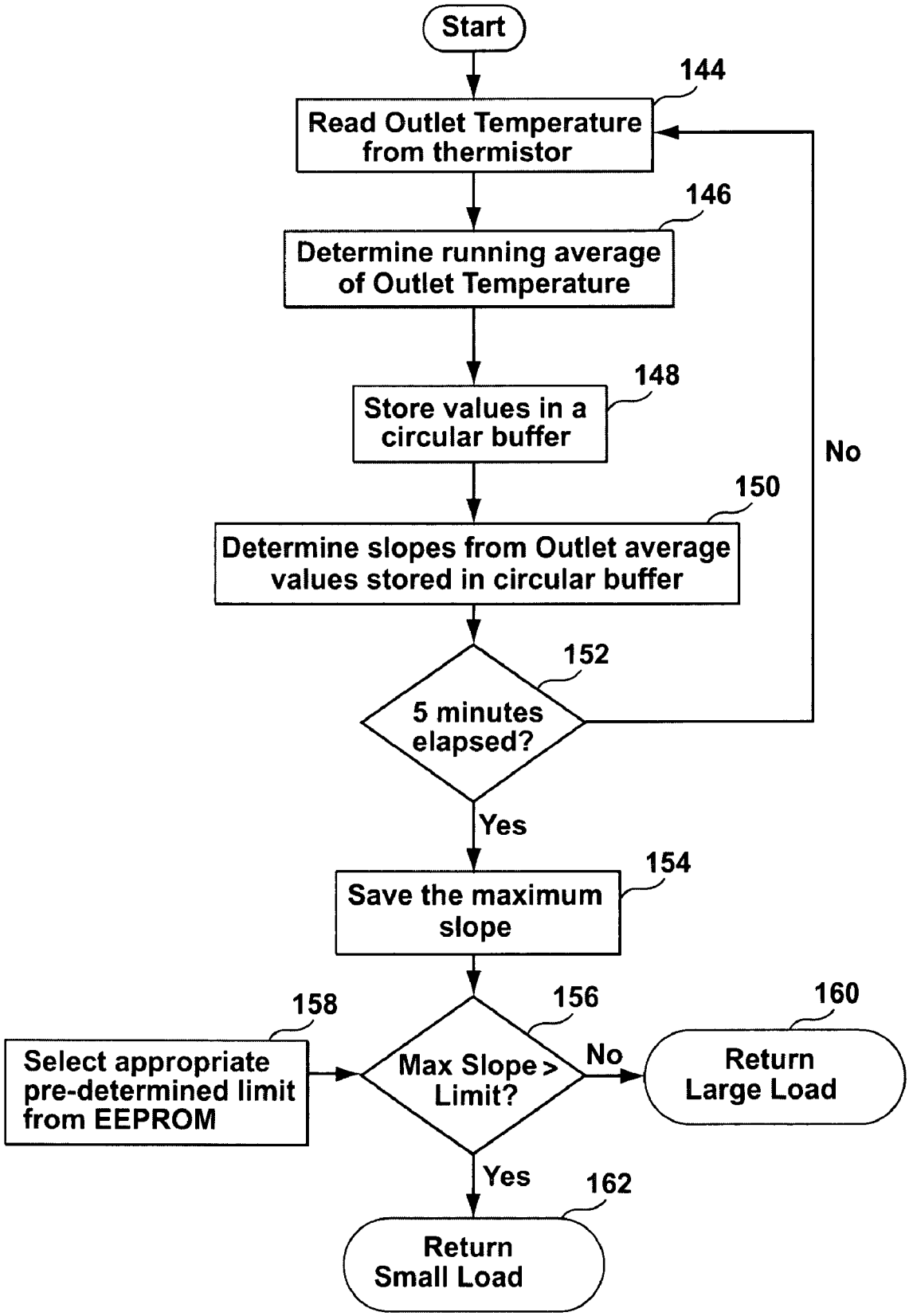
FIG. 8 is an exemplary flow chart for generating a first load size input signal in accordance with the present invention.

The load size temperature sub-module 98 executes the steps shown in FIG. 8 to generate a temperature load size signal which could be either a first small load size signal or a first large load size signal dependent upon the slope of the curve of a temperature rise at the outlet of the drum relative to the predetermined line or slope at 142. At step 144, module 94 senses the outlet temperature of the air exiting the drum by reading the outlet temperature from the thermistor 54. At steps 146, 148, 150 and 152 module 94 measures a slope corresponding to the rise of the outlet temperature during a time interval of five minutes from the start of operation of the dryer. The measurement of this slope is determined at 146 by determining the running average of the outlet temperature over a predetermined number of successively sampled outlet temperature values. This might be groups of eight samples of temperatures where an average is determined and then a mutually exclusive second set of eight samples where another average is determined. Alternatively the averaging may comprise an average determined for each successive sample for that sample and the preceeding seven samples. The running average of the outlet temperature is stored in a circular buffer 148. By looking at running averages of the outlet temperature, the module 98 compensates for noise in the outlet temperature signal 54A. By storing the signal in a circular buffer 148, minimal amount of memory is required as this buffer stores two successive samples. With the generation of every new sample average, the oldest sample average is erased from the buffer.

The slope of the temperature rise is determined at step 150 wherein the average outlet temperature values stored in the circular buffer 148 are compared to determine the gradient or slope of temperature change. The slope values are calculated at step 150 and the slope value is sent to the buffer 154. Once five minutes has elapsed at step 152, no new slope values are calculated and the slope value saved at buffer 154 will be the maximum slope value of all the slope values calculated at step 150. It should be understood that the buffer 154 compares each slope value received and only stores the slope value that has the maximum slope.

The maximum slope at 154 after five minutes has elapsed is then compared at step 156 with a maximum slope limit that is stored in the memory at 158. This predetermined slope limit 158 corresponds to the slope of line 142 shown in FIG. 7 and in this embodiment corresponds to a load size of 4 pounds. It should be understood that the 4 pound load size is a preferred choice and that other slopes may be chosen corresponding to other weight values. In the event that the maximum slope stored in buffer 154 is greater than the predetermined load size limit, then a small load signal is returned at 160 to the load size generating module 96. In the event that the maximum slope of the saved slope in buffer 154 is less than or equal to the predetermined slope stored in memory 158, then a large load return signal is forwarded from the sub-module 98 to the load size generating module 96.

While the load size signal generated by module 96 may be sufficient to generate a load size parameter for the target moisture signal table 92, it is recognized that the temperature increase determined at the outlet is a less precise measurement than the temperature increase determined at the inlet. Accordingly, the present invention employs a complimentary indicator for the load size generating module. This additional or complimentary indicator is shown as the load size moisture sub-module 100 in FIG. 3.

Figure 9:
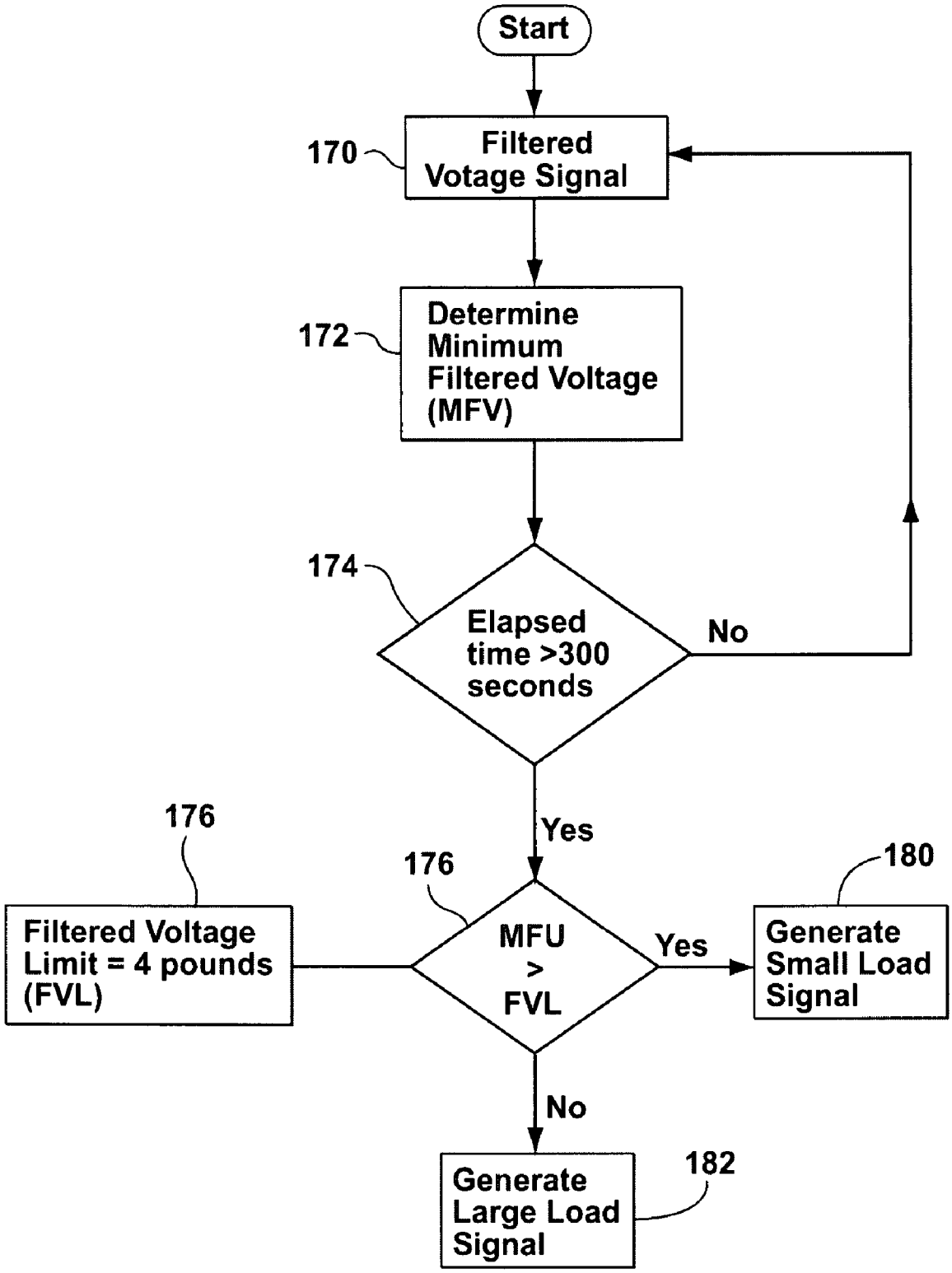
FIG. 9 is an exemplary flow chart for generating a second load size input signal in accordance with the present invention.

The load size moisture sub-module 100 described in the detailed description operates in accordance with the flow chart shown in FIG. 9 which to the determination of a minimum filtered voltage from the filtered voltage. It should be understood that the filtered voltage is proportional to the resistance of the clothes, and when the filtered voltage is chosen to have a low value for clothes that are wet and a higher value when clothes are dry, as in the detailed description, then a minimum filtered voltage is determined. In embodiments where the filtered voltage is chosen to be high for clothes that are wet and lower for clothes that are dry, then a maximum filtered voltage is determined, and the logic set out for FIG. 9 and discussed below would be the inverse. In FIG. 9, the load size moisture sub-module 100 is responsive to the filtered moisture signal at step 170 determined by the dryer processor 90. The load size moisture sub-module 100 generates a second small load signal or a second large load signal when the minimum filtered voltage is respectively less than or greater than a filtered voltage limit. The load size moisture sub-module executes this using the steps shown in FIG. 9. In the event the dryer is operating in the first three hundred seconds or five minutes, the load size moisture sub-module 100 does not return a signal to the load size generating module 96. Once three hundred seconds has elapsed at step 174, the load size moisture sub-module 100 takes the minimum filtered voltage level determined at step 172 and compares it in step 178 with a filtered voltage limit from step 176. The filtered voltage limit is stored in memory. In the event that the minimum filtered voltage is greater than the filtered voltage limit then a small load signal is generated at step 180 to the load size generating module 96. In the event that the minimum filtered voltage is less than or equal to the filtered voltage limit, then a large load size signal is generated at step 182 by the load size moisture sub-module 100 and sent to the load size generating module 96. The predetermined filtered voltage limit is chosen to represent a load size of approximately four pounds. It should also be understood that in an alternative embodiment that a large load signal may be returned to the load size generating module when the minimum filtered voltage equals the filtered voltage limit.

The load size generating module 96 then compares the signals received from the load size temperature sub-module 98 and the load size moisture sub-module 100. The load size generating module 96 compares these two signals and when the signals match i.e. the load size temperature signal and the load size moisture signal are in agreement, then the load size generating module outputs to the target moisture signal table a parameter indicative of the matching large load or small load parameter condition. In the event that the load size moisture sub-module 100 generates a load size signal that is the opposite of the load size temperature signal generated by the load size temperature sub-module 98, then the load size generating module 96 determines which one of the load size temperature signal and the load size moisture signal is furthest from its respective limit and chooses that furthest signal as the load size parameter to be sent to the target moisture signal table 92.

With the air flow restriction generating module 94 and the load size generating module 96 both inputting back to the target moisture signal table 92 parameter values associated with air flow restriction and load size, the dryer processor 90 is then able to select the target value for the moisture signal during the initial stages of start up of the dryer which more appropriately represents conditions in the dryer.

While FIG. 9 relates to a load size determination with respect to a minimum filtered voltage limit where wetter clothing is chosen to have a lower voltage, the load size determination could be just as effective using a maximum filtered voltage limit where wetter clothing is chosen to have a higher voltage. For a maximum filtered voltage, the MFV of blocks 172 and 178 would represent a Maximum filtered voltage and the operator in comparison block 178 would be inverted to be a less than operator. To describe both the maximum and minimum filtered voltage conditions within the scope of the present invention, the sub-module 100 effectively determines an extremum filtered voltage and compares this extrememum filtered voltage with a filtered voltage limit. As a result of this comparison an additional small or large load parameter or signal is generated.

It should be understood that the present invention does not utilize precise air flow restriction values or the load size values for the dryer but instead provides parameters that are indicative of two potential air flow restriction states or two potential load size states. The use of the two states for each parameter conserves on the amount of memory required by controller 58. It should be understood that in an alternative embodiment, where more memory is available, then more than one predetermined limit could be used. That is the load size generating module and the air flow restricting module are adapted to each return three parameters respectively indicative of load size and of air flow restriction, then this results in nine target voltages being stored in the target moisture signal table. While more target moisture signal values are beneficial to the dryer processor 90 estimation of stop time for the dryer, the present invention using two states generating four target moisture values is an improvement over the use of one target moisture value.

While the invention has been described in terms of various specific embodiments, those skilled in the art will recognize that the invention can be practiced with modifications within the spirit and scope of the present invention as disclosed herein.

What is claimed is:

1. An appliance for drying clothing articles, the appliance comprising:

a drum for receiving the clothing articles;

a motor for rotating the drum about an axis;

a heater for supplying heated air to the drum during a drying cycle;

a moisture sensor for providing on an output thereof a moisture signal indicative of the moisture content of the clothing articles;

an outlet temperature sensing thermistor for sensing temperature of air exiting from the drum and generating a drum output temperature signal at an output for the sensing thermistor;

a load parameter generating module being coupled to the output of the outlet temperature sensing thermistor for receiving the output temperature signal, the load parameter generating module measuring a slope of the output temperature signal corresponding to rise of the outlet temperature of air exiting from the drum during an initial time period of operation of the dryer, the load parameter generating module comparing the slope with a value indicative of a predetermined slope for rise of the outlet temperature during the initial period, the load parameter generating module having an output, and the load parameter generating module generating and outputting to its output one of a small load input parameter and a large load input parameter, the small load input parameter being generated when the load parameter generating module determines that the slope is greater than the value, and the large load input parameter being generated when the load parameter generating module determines that the slope is less than the value; and, a processor coupled to the moisture sensor output and the load parameter generating module output for estimating the stop time of the dry cycle as the dry cycle is executed based on the moisture signal representative of the moisture content of the clothing articles and a selected target signal wherein the processor selects the selected target signal based on at least one of a small load input parameter and a large load input parameter received from the load parameter generating module output.

2. The appliance of claim 1 wherein the small load input parameter is transmitted to the processor when the slope equals the value.

3. The appliance of claim 1 wherein the large load input parameter is transmitted to the processor when the slope equals the value.

4. The appliance of claim 1 wherein the load parameter measures the slope by periodically sampling the outlet temperature to provide sampled outlet temperature values, by determining running temperature averages for the outlet temperature utilizing a predetermined number of successive sampled outlet temperature values, by determining running slopes between successive running temperature averages, and by comparing each of the running slopes to determine which of the running slopes is largest and setting the value of the largest running slope to be the slope.

* * * * *